US008882081B2

(12) United States Patent
Deng

(10) Patent No.: US 8,882,081 B2
(45) Date of Patent: Nov. 11, 2014

(54) LINE GUIDING STRUCTURE

(75) Inventor: Hong-Tao Deng, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 171 days.

(21) Appl. No.: 13/703,344

(22) PCT Filed: May 17, 2012

(86) PCT No.: PCT/CN2012/075629

§ 371 (c)(1),
(2), (4) Date: Dec. 10, 2012

(87) PCT Pub. No.: WO2013/143210

PCT Pub. Date: Oct. 3, 2013

(65) Prior Publication Data

US 2013/0256363 A1 Oct. 3, 2013

(30) Foreign Application Priority Data

Mar. 31, 2012 (CN) ..... 2012 1 0092743

(51) Int. Cl.

| | |
|---|---|
| ***B66D 3/08*** | (2006.01) |
| ***B65H 57/12*** | (2006.01) |
| ***B65H 57/16*** | (2006.01) |
| ***B65H 57/28*** | (2006.01) |
| ***B65H 57/14*** | (2006.01) |

(52) U.S. Cl.

CPC ..... *B65H 57/12* (2013.01); *B65H 57/16* (2013.01); *B65H 57/28* (2013.01); *B65H 57/14* (2013.01)

USPC ..... 254/393; 254/392; 254/394; 254/395; 242/615.1; 242/615.3; 242/397; 248/332

(58) Field of Classification Search

CPC ..... B65H 57/12; B65H 57/28; B65H 57/16; B65H 57/14

USPC ..... 248/580, 55, 68.1, 73, 220.21, 220.22, 248/222.52, 309.1, 332; 254/392, 393, 394, 254/395; 242/615.1, 615.3, 397; 226/181

See application file for complete search history.

(56) References Cited

U.S. PATENT DOCUMENTS

| | | | | |
|---|---|---|---|---|
| 790,343 | A * | 5/1905 | Channon | 254/394 |
| 916,081 | A * | 3/1909 | Williams | 104/117 |

(Continued)

FOREIGN PATENT DOCUMENTS

| | | | |
|---|---|---|---|
| CN | 1584363 | A | 2/2005 |
| CN | 201706064 | U | 1/2011 |

(Continued)

*Primary Examiner* — Terrell McKinnon
*Assistant Examiner* — Michael McDuffie
(74) *Attorney, Agent, or Firm* — Muncy, Geissler, Olds & Lowe, P.C.

(57) ABSTRACT

A line guiding structure comprises a round guiding shaft, a fixing unit, an elastic element, a linear bearing and a wheel set. The round guiding shaft comprises a fixing and an open end. The fixing unit is used for fixing the round guiding shaft and comprises a fixing base and a bearing. The fixing base is disposed on mechanical equipment, and the bearing is disposed in the fixing base. The elastic element is sleeved on the round guiding shaft and comprises a first end and a second end. The linear bearing is sleeved on the round guiding shaft. A connecting piece is disposed on the linear bearing. The wheel set comprises a fixing plate, a supporting frame and two pulleys. The fixing plate is connected on the connecting piece. A slide hole is formed between two opposite pulley surfaces of the two pulleys for a line to pass through.

19 Claims, 5 Drawing Sheets

(56) References Cited

U.S. PATENT DOCUMENTS

| | | | | | |
|---|---|---|---|---|---|
| 1,264,894 | A | * | 5/1918 | Campbell | 254/267 |
| 1,940,701 | A | * | 12/1933 | Shope | 242/371 |
| 3,393,889 | A | * | 7/1968 | Ogden | 248/364 |
| 3,602,467 | A | * | 8/1971 | Thomas | 248/55 |
| 3,834,674 | A | * | 9/1974 | Jackson | 254/394 |
| 4,019,715 | A | * | 4/1977 | Vugrek | 254/134.3 R |
| 4,479,453 | A | * | 10/1984 | Bonassi | 114/218 |
| 4,667,625 | A | * | 5/1987 | Malone | 119/785 |
| 5,101,735 | A | * | 4/1992 | Williams | 104/117 |
| 6,364,256 | B1 | | 4/2002 | Neider et al. | |
| 7,175,125 | B2 | * | 2/2007 | Redaelli | 242/474.7 |
| 7,802,666 | B2 | * | 9/2010 | Maino | 191/12 R |
| 8,225,875 | B2 | * | 7/2012 | Begnaud et al. | 166/378 |
| 8,286,927 | B2 | * | 10/2012 | Sweere et al. | 248/297.21 |
| 2006/0231668 | A1 | | 10/2006 | Park | |
| 2011/0042355 | A1 | * | 2/2011 | Gelmetti | 219/73 |

FOREIGN PATENT DOCUMENTS

| | | | |
|---|---|---|---|
| CN | 102088174 | A | 6/2011 |
| JP | 2011-102497 | A | 5/2011 |

* cited by examiner

LINE GUIDING STRUCTURE

FIELD OF THE INVENTION

The present invention relates to a line guiding structure and more particularly to a line guiding structure employed in three-dimension.

BACKGROUND

There are many lines in various types of mechanical equipment such as cables, air pipes, oil pipes, water pipes, etc. Some of the lines are in movement when the mechanical parts are moving. The lines can be easily damaged by bending during movements. Conventionally, the lines are guided by a tank chain or an energy chain. However, this type of structure in mechanical equipment can only achieve planar guiding. The structure can only be employed in lines which are flexible in nature but not the harder lines which are difficult to be bent.

SUMMARY OF THE INVENTION

An objective of the present invention is to provide a line guiding structure which can overcome the drawbacks of the conventional technique by guiding a line in a three-dimensional space.

A technical solution provided by the present invention to overcome the above technical problems includes a line guiding structure for using in a mechanical equipment and a line connected to the mechanical equipment. The line guiding structure comprises: a round guiding shaft, the round guiding shaft comprising a fixing end and an open end disposed oppositely to the fixing end; a fixing unit used for fixing the round guiding shaft and the fixing unit comprising a fixing base and a bearing, the fixing base being disposed on the mechanical equipment, the bearing being disposed in the fixing base and being connected to the fixing end of the round guiding shaft; an elastic element sleeved on the round guiding shaft and the elastic element comprising a first end and a second end disposed oppositely to the first end, the first end being fixed on an end of the round guiding shaft near the fixing end; a linear bearing sleeved on the round guiding shaft and connected to the second end of the elastic element, a connecting piece connected to the linear bearing; and at least one wheel set comprising a fixing plate, a supporting frame connected on the fixing plate and two pulleys disposed on the supporting frame, the fixing plate being connected on the connecting piece, the two pulleys and the round guiding shaft having the same axial direction, a slide hole being formed in a space between two opposite pulley surfaces of the two pulleys for a line to go through.

In an embodiment of the present invention, the mechanical equipment has a first portion and a second portion which can move relatively to the first portion. The line is connected between the first portion and the second portion. The fixing base is disposed on the first portion of the mechanical equipment. Two ends of the line are connected to the first portion and the second portion respectively.

In an embodiment of the present invention, the round guiding shaft is a steel rail.

In an embodiment of the present invention, the elastic element is a retractable spring.

In an embodiment of the present invention, the fixing plate and the connecting piece are screwed together by bolts.

In an embodiment of the present invention, there is a plurality of the wheel sets and each of the wheel sets is disposed on the connecting piece sequentially along the axial direction of the round guiding shaft.

In an embodiment of the present invention, the pulley surfaces of the pulleys are smooth surfaces with a low friction coefficient.

In an embodiment of the present invention, the line includes cable, air pipe, oil pipe and water pipe. The mechanical equipment includes numerical control machine tool, electronic equipment, stone-working machinery, glass-working machinery, door and window machine, injection molding machine, manipulator, heavy-duty transportation equipment and auto-warehouse.

Comparing the conventional techniques with the line guiding structure of the present invention, by employing the round guiding shaft, the elastic element and the linear bearing sleeved on the surface of the round guiding shaft, and the wheel set connected to the linear bearing; the line can slide freely in the slide hole of the wheel set. Furthermore, because the linear bearing can rotate and move upward and downward freely on the round guiding shaft, the line can be guided three-dimensionally instead of the conventional way of dragging on a two-dimensional plane like a tank chain.

The present invention will become more fully understood by reference to the following detailed description thereof when read in conjunction with the attached drawings.

DETAILED DESCRIPTION OF THE INVENTION

Figure 1:
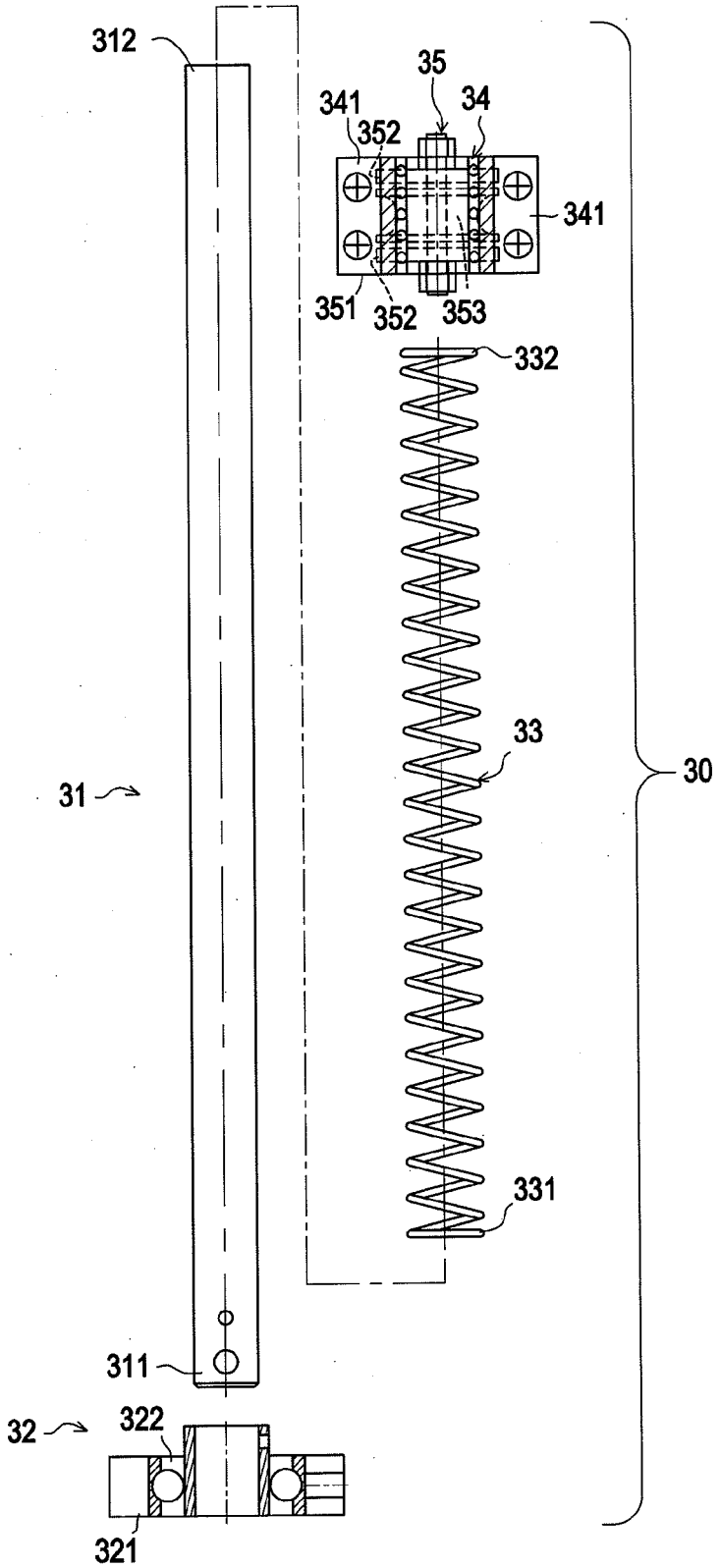
FIG. 1 is an exploded view of a line guiding structure of the present invention.
Figure 2:
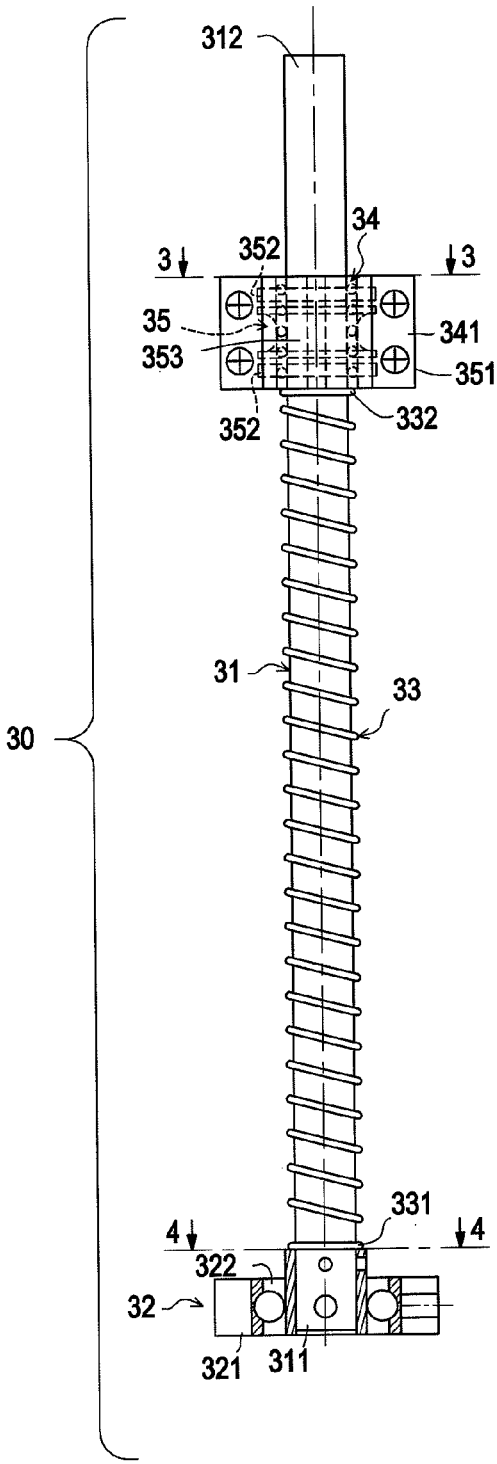
FIG. 2 is an assembly view of the line guiding structure of the present invention.
Figure 3:
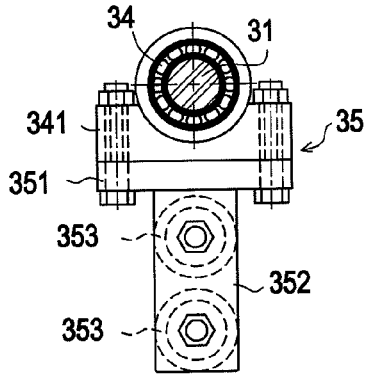
FIG. 3 is a sectional view of FIG. 2 along line 3-3.
Figure 4:
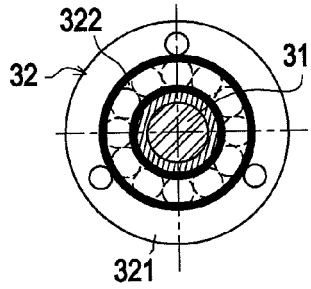
FIG. 4 is a sectional view of FIG. 2 along line 4-4.

Reference will now be made in detail to the preferred embodiment of the present disclosure, examples of which are illustrated in the accompanying drawings.

Please refer to FIGS. 1, 2, 3 and 4. A line guiding structure 30 of the present invention is suitable for using in a mechanical equipment 10 and a line 20 connected to the mechanical equipment 10. The line guiding structure 30 comprises a round guiding shaft 31, a fixing unit 32, an elastic element 33, a linear bearing 34 and at least one wheel set 35. The round guiding shaft 31 can be made in steel. The round guiding shaft 31 comprises a fixing end 311 and an open end 312 disposed oppositely to the fixing end 311 (that is, the other end of the fixing end 311). The fixing unit 32 is used for fixing the round guiding shaft 31 and the fixing unit 32 comprises a fixing base 321 and a bearing 322. The fixing base 321 is disposed on the mechanical equipment 10. The bearing 322 is disposed in the fixing base 321 and the fixing end 311 of the round guiding shaft 31 is connected to an inner diameter of the bearing 322, so that the round guiding shaft 31 can rotate for 360 degrees relative to the fixing base 321. The elastic element 33 is sleeved on an outer diameter of the round guiding shaft 31 and the elastic element 33 comprises a first end 331 and a second end 332 disposed oppositely to the first end 331. The first end 331 is fixed on an end of the round guiding shaft 31 near the fixing end 311. The linear bearing 34 is sleeved on the round guiding shaft 31 and is connected to the second end 332 of the elastic element 33. A connecting piece 341 is disposed on a surface of the linear bearing 34. The at least one wheel set 35 comprises a fixing plate 351, a supporting frame 352 connected on the fixing plate 351 and two pulleys 353 disposed on the supporting frame 352. The fixing plate 351 is connected (e.g. by bolts) on the connecting piece 341. The two pulleys 353 and the round guiding shaft 31 have the same axial direction. A slide hole 354 is formed in a space between two opposite pulley surfaces 3531 of the two pulleys 353 for the line 20 to pass through.

Figure 5:
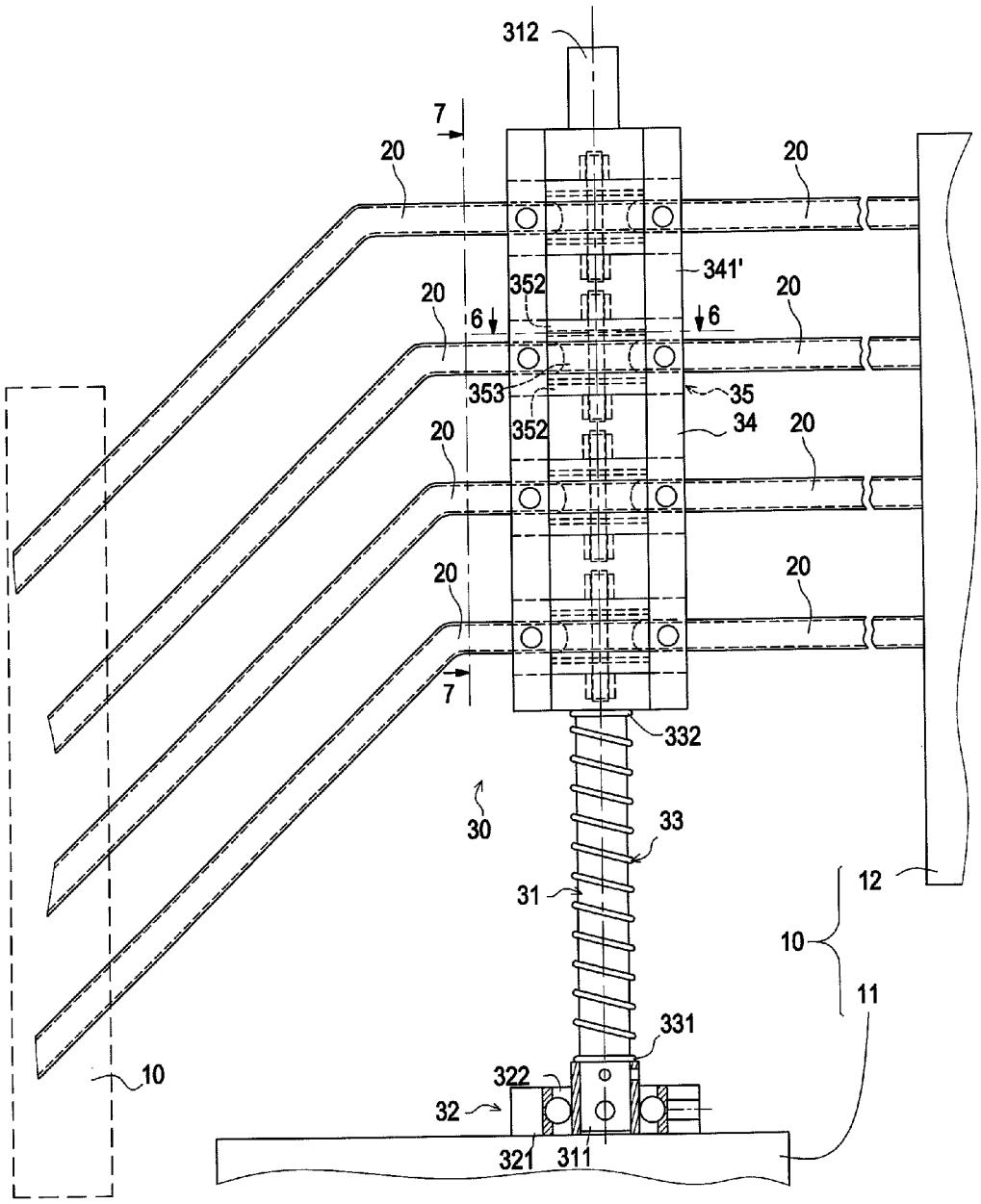
FIG. 5 is an illustration of the line guiding structure disposing on mechanical equipment and lines being guided according to an embodiment of the present invention.
Figure 6:
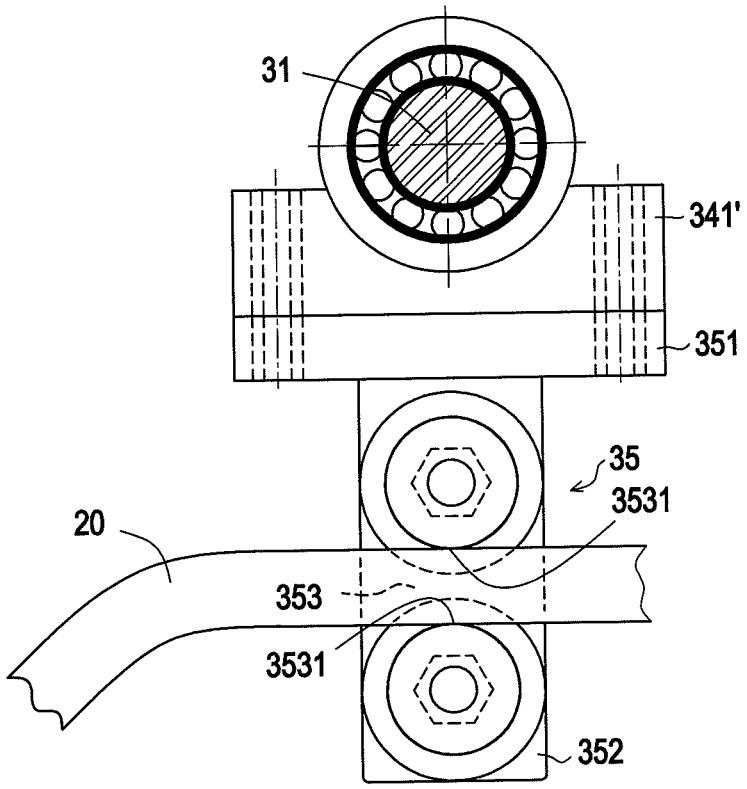
FIG. 6 is a sectional view of FIG. 5 along line 6-6.
Figure 7:
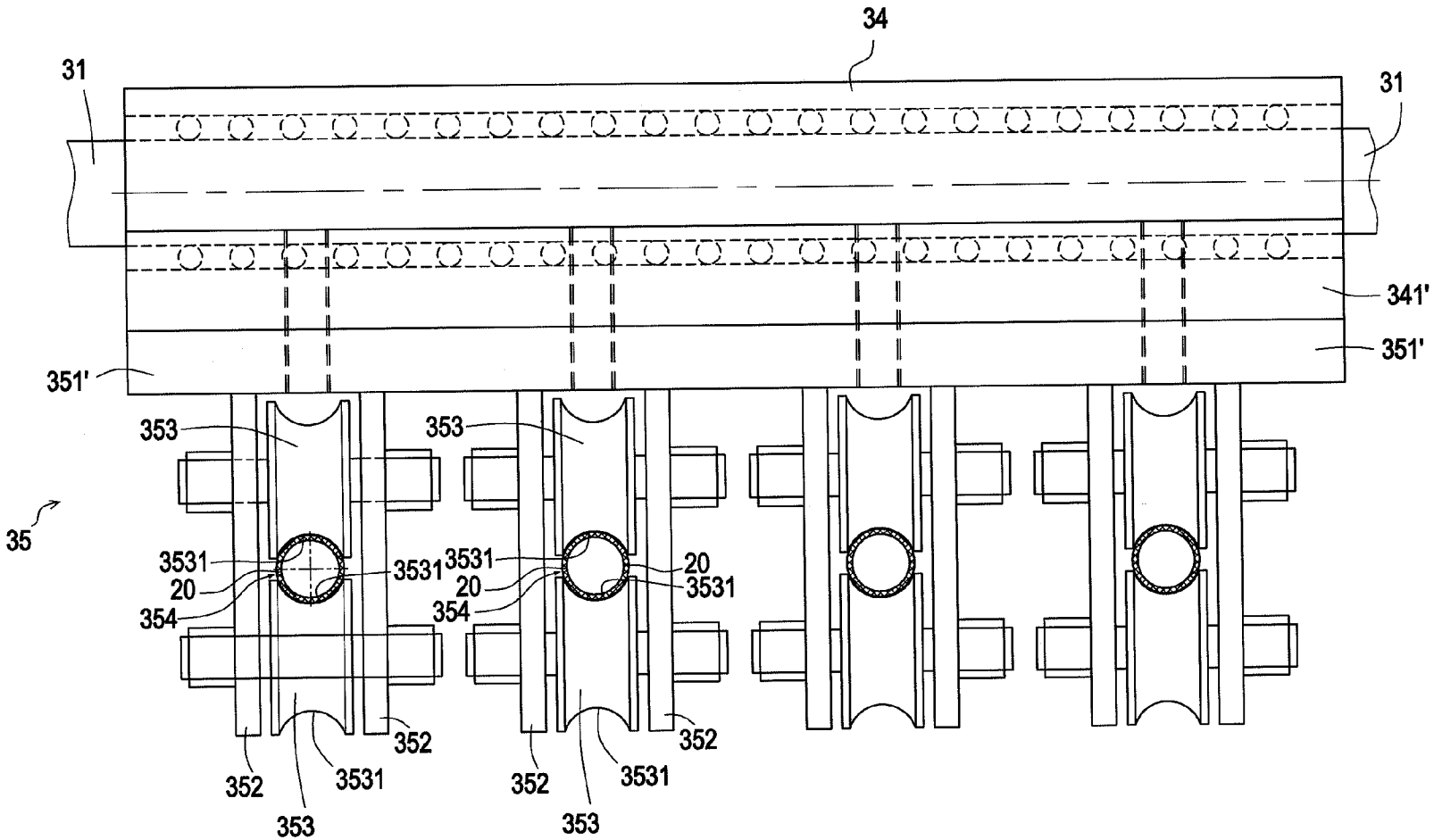
FIG. 7 is a sectional view of FIG. 5 along line 7-7.

Refer to FIGS. 5, 6 and 7. According to the structures mentioned above, the line 20 of the mechanical equipment 10 passes through the slide hole 354. The mechanical equipment 10 has a first portion 11 and a second portion 12 which can move relatively to the first portion 11. The line 20 is connected between the first portion 11 and the second portion 12. The fixing unit 32 is disposed on the first portion 11 or the second portion 12 of the mechanical equipment 10. The linear bearing 34 can rotate for 360 degrees in horizontal (the radial direction of the round guiding shaft 31) around the round guiding shaft 31 and can also move upward and downward axially around the round guiding shaft 31. When the linear bearing 34 moves upward, it is supported by the elasticity of the elastic element 33 (e.g. a retractable spring) so that the line 20 connected to the linear bearing 34 is tightened. Therefore, the line 20 can be avoided from being damaged because of bending caused by the relative movement of the first portion 11 and the second portion 12. When the linear bearing 34 moves downward, the linear bearing 34 is dragged downward by the tension of the line 20 and is pressed against the elastic element 33. It should be noted that, the elasticity coefficient of the elastic element 33 is related to the weight of the linear bearing 34 and the type of the line 20.

In an embodiment of the present invention, the line 20 includes cables, air pipes, oil pipes and water pipes. The mechanical equipment 10 includes numerical control machine tool, electronic equipment, stone-working machinery, glass-working machinery, door and window machine, injection molding machine, manipulator, heavy-duty transportation equipment and auto-warehouse.

In an embodiment of the present invention, the pulley surfaces 3531 of the pulleys 353 are smooth surfaces with a low friction coefficient.

In an embodiment of the present invention, there is a plurality of the wheel sets 35 and each of the wheel sets 35 is disposed on the fixing plate 351' sequentially along the axial direction of the round guiding shaft 31. The fixing plate 351' is connected to the connecting piece 341'.

In the line guiding structure 30 of the present invention, by employing the round guiding shaft 31, the elastic element 33 and the linear bearing 34 sleeved on the outer diameter of the round guiding shaft 31, and the wheel set 35 connected to the linear bearing 34; the line 20 can slide freely in the slide hole 354 of the wheel set 35. Furthermore, because the linear bearing 34 can rotate and move upward and downward freely on the round guiding shaft 31, the line 20 can be guided three-dimensionally.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A line guiding structure applied to a mechanical equipment and a line connected to the mechanical equipment, the line guiding structure comprises:

a round guiding shaft comprising a fixing end and an open end disposed oppositely to the fixing end;

a fixing unit used for fixing the round guiding shaft and the fixing unit comprises a fixing base and a bearing, the fixing base is disposed on the mechanical equipment, the bearing is disposed in the fixing base;

an elastic element sleeved on the round guiding shaft and the elastic element comprises a first end and a second end disposed oppositely to the first end, the first end is fixed on an end of the round guiding shaft near the fixing end;

a linear bearing sleeved on the round guiding shaft and connected to the second end of the elastic element, a connecting piece is disposed on a surface of the linear bearing; and a plurality of wheel sets, and each wheel set comprising a fixing plate, a supporting frame connected on the fixing plate and two pulleys disposed on the supporting frame, the fixing plate is connected on the connecting piece, the two pulleys and the round guiding shaft have a same axial direction, a slide hole is formed in a space between two opposite pulley surfaces of the two pulleys for the line to pass through, the plurality of wheel sets is disposed sequentially along an axial direction of the round guiding shaft and connected to the fixing plate, the fixing plate is connected to the connecting piece, a surface of each pulley is a smooth surface with a low friction coefficient;

the mechanical equipment has a first portion and a second portion which can move relatively to the first portion, the line is connected between the first portion and the second portion, the fixing base is disposed on the first portion of the mechanical equipment, two ends of the line are connected to the first portion and the second portion respectively, the fixing plate and the connecting piece are screwed together by a bolt, the line includes a cable, an air pipe, an oil pipe or a water pipe, the mechanical equipment includes numerical control machine tool, electronic equipment, stone-working machinery, glass-working machinery, door and window machine, injection molding machine, manipulator, heavy-duty transportation equipment and auto-warehouse.

2. A line guiding structure applied to a mechanical equipment and a line connected to the mechanical equipment, the line guiding structure comprises: a round guiding shaft comprising a fixing end and an open end disposed oppositely to the fixing end; a fixing unit used for fixing the round guiding shaft and the fixing unit comprises a fixing base and a bearing, the fixing base is disposed on the mechanical equipment, the bearing is disposed in the fixing base, the fixing end of the round guiding shaft is connected to the bearing; an elastic element sleeved on the round guiding shaft and the elastic element comprises a first end and a second end disposed oppositely to the first end, the first end is fixed on an end of the round guiding shaft near the fixing end; a linear bearing sleeved on the round guiding shaft and connected to the second end of the elastic element, a connecting piece is disposed on a surface of the linear bearing; and at least one wheel set comprising a fixing plate, a supporting frame connected on the fixing plate and two pulleys disposed on the supporting frame, the fixing plate is connected on the connecting piece, the two pulleys and the round guiding shaft have a same axial direction, a slide hole is formed in a space between two opposite pulley surfaces of the two pulleys for the line to pass through.

3. The line guiding structure as claimed in claim 2, wherein the mechanical equipment has a first portion and a second portion which can move relatively to the first portion, the line is connected between the first portion and the second portion, the fixing base is disposed on the first portion of the mechanical equipment.

4. The line guiding structure as claimed in claim 3, wherein two ends of the line are connected to the first portion and the second portion respectively.

5. The line guiding structure as claimed in claim 2, wherein the round guiding shaft is a steel rail.

6. The line guiding structure as claimed in claim 3, wherein the round guiding shaft is a steel rail.

7. The line guiding structure as claimed in claim 4, wherein the round guiding shaft is a steel rail.

8. The line guiding structure as claimed in claim 2, wherein the elastic element is a retractable spring.

9. The line guiding structure as claimed in claim 3, wherein the elastic element is a retractable spring.

10. The line guiding structure as claimed in claim 4, wherein the elastic element is a retractable spring.

11. The line guiding structure as claimed in claim 2, wherein the fixing plate and the connecting piece are screwed together by a bolt.

12. The line guiding structure as claimed in claim 3, wherein the fixing plate and the connecting piece are screwed together by a bolt.

13. The line guiding structure as claimed in claim 4, wherein the fixing plate and the connecting piece are screwed together by a bolt.

14. The line guiding structure as claimed in claim 2, further comprising a plurality of the wheel sets and each of the wheel sets being sequentially along the axial direction of the round guiding shaft and connected on the fixing plate, the fixing plate being connected to the connecting piece.

15. The line guiding structure as claimed in claim 3, further comprising a plurality of the wheel sets and each of the wheel sets being sequentially along the axial direction of the round guiding shaft and connected on the fixing plate, the fixing plate being connected to the connecting piece.

16. The line guiding structure as claimed in claim 4, further comprising a plurality of the wheel sets and each of the wheel sets being sequentially along the axial direction of the round guiding shaft and connected on the fixing plate, the fixing plate being connected to the connecting piece.

17. The line guiding structure as claimed in claim 2, wherein a surface of the pulley is a smooth surface with a low friction coefficient.

18. The line guiding structure as claimed in claim 3, wherein a surface of the pulley is a smooth surface with a low friction coefficient.

19. The line guiding structure as claimed in claim 4, wherein a surface of the pulley is a smooth surface with a low friction coefficient.

* * * * *